US007128128B2

(12) United States Patent
Kaba et al.

(10) Patent No.: US 7,128,128 B2
(45) Date of Patent: Oct. 31, 2006

(54) PLUNGER TIP FOR DIE CASTING MACHINES

(75) Inventors: Takahiro Kaba, Kobe (JP); Hiroshi Yamaguchi, Takatsuki (JP); Hiroshi Kawai, Toyota (JP)

(73) Assignees: Kubota Corporation, Osaka (JP); Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/165,248

(22) Filed: Jun. 24, 2005

(65) Prior Publication Data

US 2005/0284602 A1 Dec. 29, 2005

(30) Foreign Application Priority Data

Jun. 25, 2004 (JP) ..... 2004-187436
Jun. 9, 2005 (JP) ..... 2005-169046

(51) Int. Cl.
*B22D 17/04* (2006.01)
*B22D 17/08* (2006.01)

(52) U.S. Cl. ..... 164/312; 164/113

(58) Field of Classification Search ..... 164/113, 164/120, 312–321
See application file for complete search history.

(56) References Cited

U.S. PATENT DOCUMENTS 6,415,705 B1 * 7/2002 Kato et al. ..... 92/71
2002/0153120 A1 * 10/2002 Ito et al. ..... 164/113

FOREIGN PATENT DOCUMENTS

JP 9-94648 4/1997

* cited by examiner

*Primary Examiner*—Kuang Y. Lin
(74) *Attorney, Agent, or Firm*—Armstrong, Kratz, Quintos, Hanson & Brooks, LLP

(57) ABSTRACT

The invention provides a plunger tip for die casting machines which is excellent in slidability and sealing properties. The plunger tip comprises a tip main body (20) and is slidable inside a plunger sleeve (60) for pushing out a molten metal into a die. The tip main body (20) is made of a metal material and covered over an outer peripheral surface thereof with a slide sleeve (40) made of a rigid resin material exhibiting high slidability and excellent sealing properties on the inner surface of the plunger sleeve.

7 Claims, 3 Drawing Sheets

PLUNGER TIP FOR DIE CASTING MACHINES

FIELD OF THE INVENTION

The present invention relates to plunger tips for use in casting molten metals by die casting machines.

BACKGROUND OF THE INVENTION

For casting molten metals, such as aluminum alloys, magnesium alloys or like nonferrous metals, by die casting machines, the molten metal is placed into a plunger sleeve and injected into the cavity of a die by a plunger tip slidable inside the plunger sleeve under pressure.

Plunger tips which must have abrasion resistance and cooling properties are generally made from a high-temperature tool steel (SKD-61) or beryllium copper.

When molten metal is injected into a die for the die casting machine, great sliding resistance is produced between the plunger tip and the plunger sleeve, so that there is a need to spray a graphite oily or water-soluble lubricant onto the sliding surface for every shot.

However, when such a lubricant comes into contact with the molten metal, a gas produced from the lubricant on burning and the remaining lubricant are likely to become incorporated into the molten metal, giving rise to the problem of degrading the die-cast product or permitting the lubricant substance to scatter to impair the work environment. Accordingly, there is a growing demand for plunger tips which exhibit stabilized injection performance without using any lubricant or with a reduction in the amount of lubricant to be applied.

A plunger tip is therefore proposed which has a tubular slide sleeve made of a carbon fiber reinforced composite material (C/C composite) and fitting around the outer periphery of the tip so as to give the tip improved slidability on the inner surface of the plunger sleeve (see, for example, the publication of JP-A No. 09-94648).

The slide sleeve provided around the plunger tip gives the tip improved slidability on the inner surface of the plunger sleeve, whereas since the C/C composite is comparable to the metal material of the plunger tip in coefficient of thermal expansion, the slide sleeve almost fails to expand when molten metal is injected under pressure. This impairs the sealing effect of the slide sleeve on the plunger sleeve, permitting the molten metal to ingress into an interstice between the plunger sleeve and the slide sleeve and causing damage to the surfaces of these sleeves.

The damage entails a shortened service life.

An object of the present invention is to provide a plunger tip for die casting machines which is excellent in slidability and sealing properties.

SUMMARY OF THE INVENTION

To fulfill the above object, the present invention provides a plunger tip for die casting machines comprising a tip main body and slidable inside a plunger sleeve for pushing out a molten metal into a die. The tip main body is made of a metal material and covered over an outer peripheral surface thereof with a slide sleeve made of a rigid resin material.

The rigid resin material exhibits high slidability and produces an excellent sealing effect on the inner surface of the plunger sleeve.

The term the "rigid resin material" as used herein and in the appended claims refers to either a thermoplastic material or a thermosetting material, but does not include a soft resin material. States more specifically, the term the "rigid resin material" means a resin material which is at least $6.895\times10^7$ Pa in modulus of elasticity.

The tip main body is covered over the outer peripheral surface thereof with a slide sleeve of rigid resin. The rigid resin slide sleeve is excellent in slidability on the inner surface of the plunger sleeve, consequently eliminating the need for the lubricant or otherwise greatly reducing the amount of lubricant to be used.

The rigid resin slide sleeve produces an excellent sealing effect on the plunger sleeve inner surface, is less prone to seizure due to the molten metal, and therefore diminishes the damage to the component material due to the ingress of the molten metal into an interstice between the slide sleeve and the plunger sleeve or scorching with the molten metal to result in a greatly improved service life.

Since the forward end of the plunger tip comes into direct contact with the molten metal, is heated to a temperature of about 600 to 700° C. and is therefore made from a metal material as a portion of the tip main body, the slide sleeve made of rigid resin can be prevented from deteriorating owing to heat.

DESCRIPTION OF THE PREFERRED EMBODIMENTS

Figure 1:
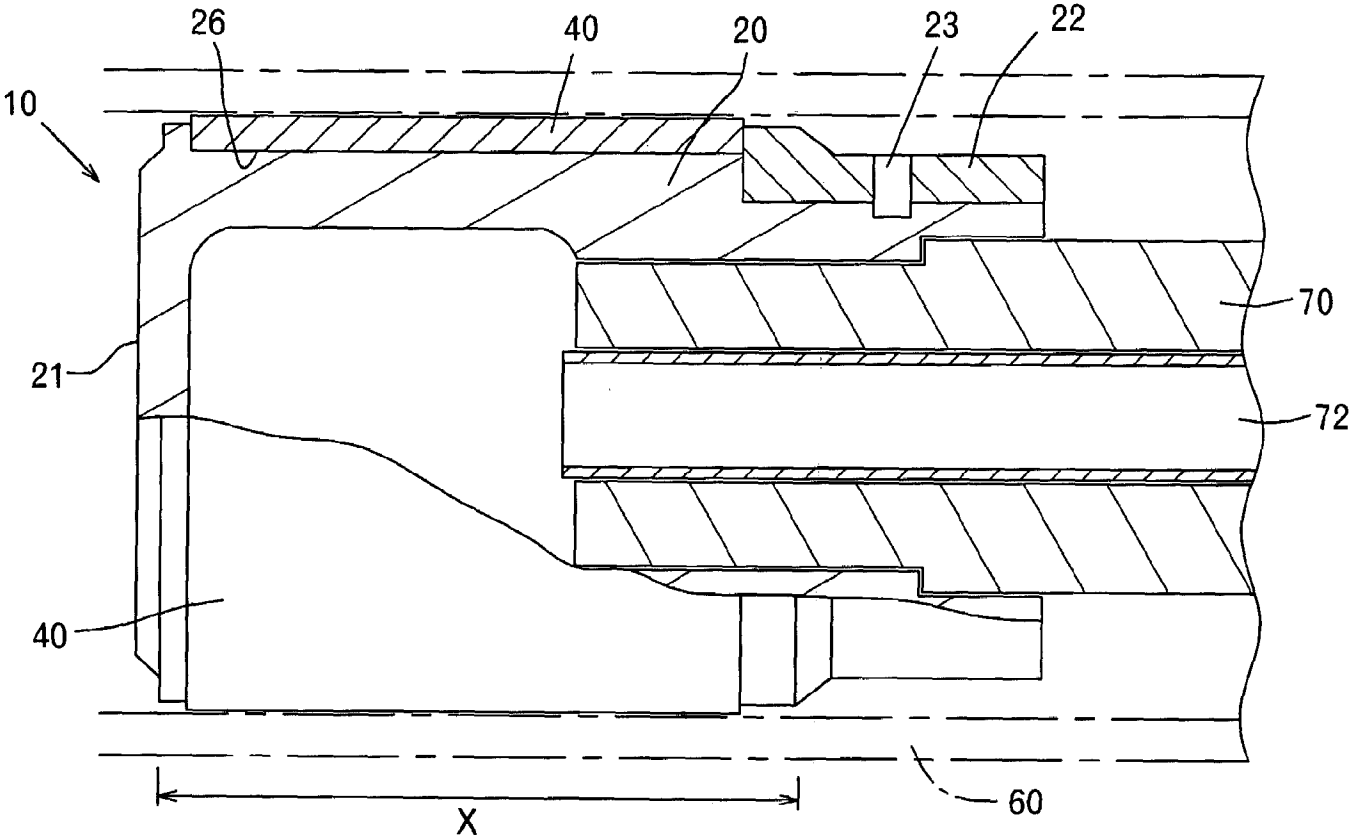
FIG. 1 is a view partly in section and showing the construction of an injection mechanism comprising a plunger tip of the invention.

FIG. 1 shows the construction of an injection mechanism for supplying a molten metal to a die casting machine. With reference to FIG. 1, the injection mechanism comprises a hollow cylindrical plunger sleeve 60 connected to the die casting machine, and a solid cylindrical plunger tip 10 slidably provided inside the plunger sleeve 60. The plunger tip 10 has a plunger rod 70 joined to the rear end thereof, and the rod 70 is coupled to a drive device (not shown). When reciprocatingly moved, the plunger rod 70 slidingly moves the plunger tip 10 inside the plunger sleeve 60, whereby the molten metal as filled in the sleeve 60 is fed to the die casting machine.

The plunger tip 10 of the present invention comprises a tip main body 20 having a closed forward end of circular contour, and a slide sleeve 40 fitted around the outer peripheral surface of the tip main body 20.

<Tip Main Body 20>

The tip main body 20 is in the form of a hollow cylinder having a closed forward end and has a retaining tube 22 fastened to a base end portion thereof with a screw 23 for preventing the slide sleeve 40 from slipping off.

The tip main body 20 is provided in its outer peripheral surface with a groove 26 extending over the entire circumference thereof and having an increased width in the axial direction thereof for the slide sleeve 40 to fit in. The side face defining the groove 26 and positioned toward the base end of the main body 20 is provided by the forward end face of the retaining tube 22.

As shown in FIG. 1, the forward end of the tip main body 20 has a head 21 of reduced diameter permitting the plunger tip 10 to advance into the plunger sleeve 60 easily.

Preferably, the tip main body 20 is provided in its hollow inside portion with a cooling water structure for preventing the rise of temperature of the main body 20. As shown in FIG. 1, the plunger rod 70 is internally provided with a cooling pipe 72 in this case, and the pipe is held in communication with the hollow inside portion of the tip main body 20.

When the plunger tip 10 need not have the cooling structure, the tip 10 may have a solid inside portion.

It is desired that the groove 26 have an axial width which is 50 to 90% of the entire length of the tip slide portion (indicated at X in FIG. 1). The groove 26 is preferably about 5 to about 10 mm in depth.

The tip main body 20 can be made from a material having high abrasion resistance and exhibiting high cooling performance, such as a high-temperature tool steel (SKD-61) or Cu alloy. Cu alloys have high heat conductivity, therefore achieve a high cooling efficiency and are desirable for making the tip main body 20. Beryllium copper (Be—Cu) can be a useful example of such a Cu alloy.

The base end side of the tip main body 20 is joined to the plunger rod 70 for reciprocatingly moving the plunger tip 10 inside the plunger sleeve 60 as shown in FIG. 1.

<Slide Sleeve 40>

With reference to FIG. 1, the slide sleeve 40 is in the form of a hollow cylinder fittable into the groove 26 of the tip main body 20 and made of a rigid resin material. The slide sleeve 40 can be mounted on the tip main body 20 by fitting the slide sleeve 40 into the groove 26, and thereafter fastening the retaining tube 22 as fitted around the tip main body 20 to the body 20 with the screw 23 so as not to permit the slide sleeve 40 to slip out of the groove 26.

The slide sleeve 40 can be made as divided into a plurality of segments, e.g., into two segments, circumferentially thereof. The slide sleeve 40 of the divided type can be provided directly into the groove 26 without removing the retaining tube 22. In the event to the slide sleeve 40 deteriorating, the slide sleeve 40 of this type has the advantage of being removable without the necessity of removing the retaining tube 22. The retaining tube 22 can be dispensed with in this case, while the retaining tube 22 can alternatively be provided integrally with the tip main body 20.

In the case where the slide sleeve 40 is of the divided type, the division lines along which the sleeve 40 is divided can be inclined with respect to the axial direction. An enhanced sealing effect is then available since the sleeve segments are subjected to a force acting to close the division lines owing to frictional contact with the inner surface of the plunger sleeve 60 when sliding.

Preferably, the slide sleeve 40 is so sized as to fit to the width of the groove 26 and to cover 50 to 90% of the outer peripheral surface of the tip main body 20, because if the area to be occupied by the slide sleeve 40 is smaller than 50% of the outer peripheral surface of the tip main body 20, the sliding load on the inner surface of the plunger sleeve 60 will increase per unit area to possibly result in lower slidability or give rise to a phenomenon of seizure during a long period of use.

Figure 2:
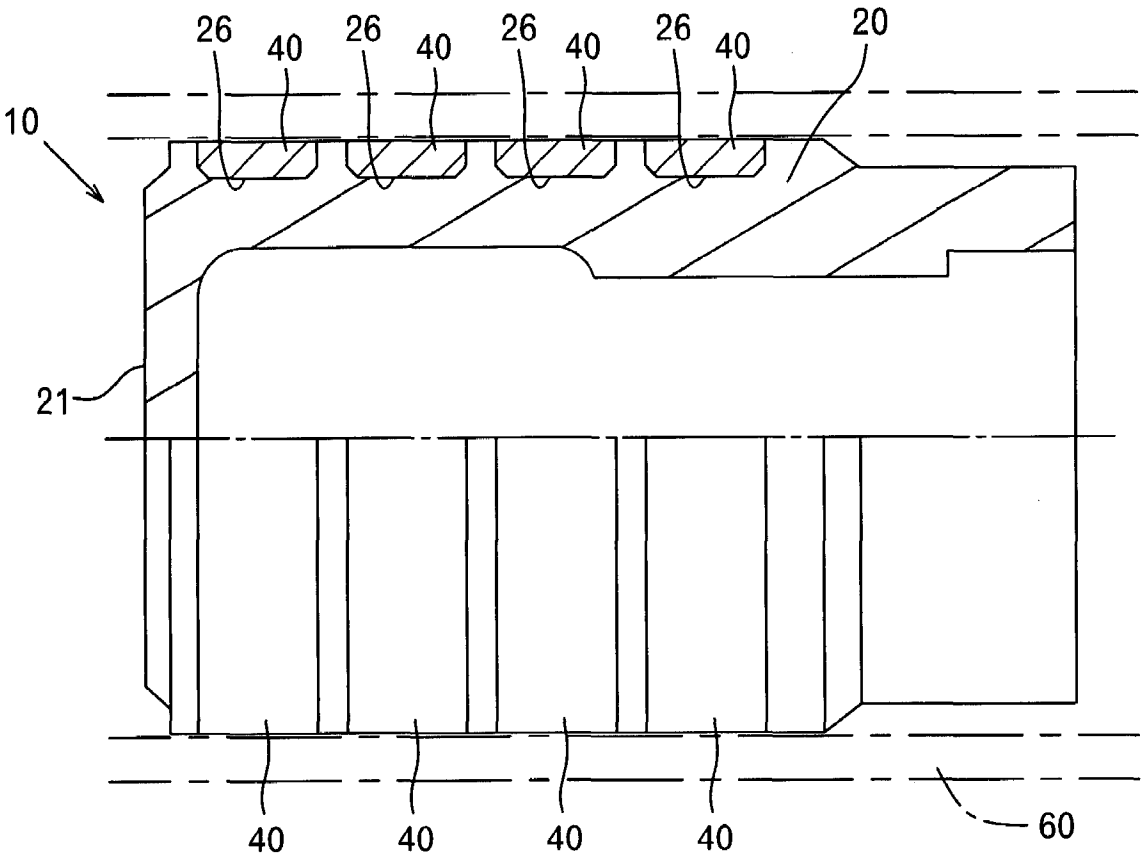
FIG. 2 is a view partly in section and showing an embodiment of plunger tip wherein a plurality of slide sleeves are arranged axially thereof.
Figure 3:
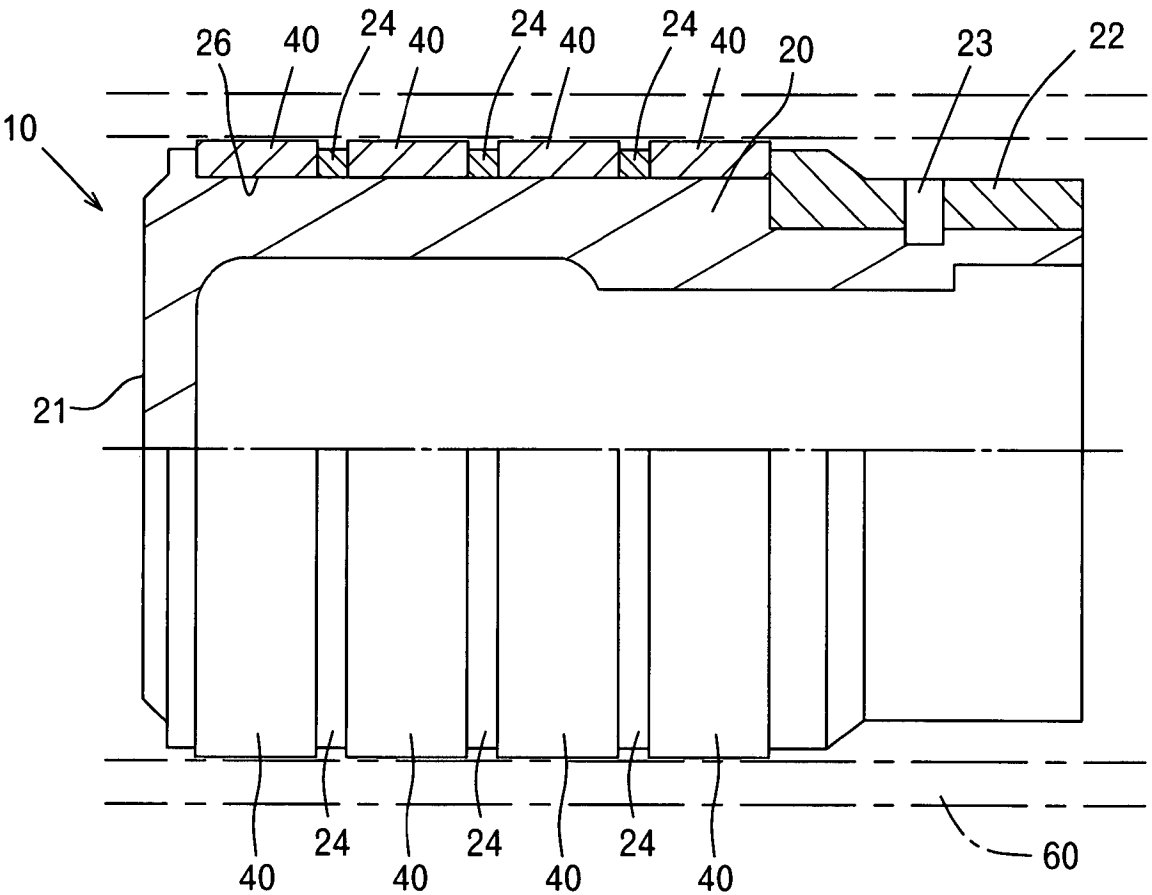
FIG. 3 is a view partly in section showing a different embodiment of plunger tip wherein a plurality of slide sleeves are arranged axially thereof.

It is desired that the slide sleeve 40 have an outside diameter which is equal to or approximately equal to the outside diameter (maximum outside diameter) of the tip main body 20 (FIG. 2), or which is larger than the outside diameter of the tip main body 20 (FIGS. 1 and 3). Even in the case where the slide sleeve 40 is made equal or approximately equal to the tip main body 20 in outside diameter, the rigid resin material thermally expands to produce a sealing effect on the inner surface of the plunger sleeve 60. When the outside diameter of the slide sleeve 40 is made greater than the outside diameter (maximum outside diameter) of the tip main body 20, the diameter difference is preferably at least 0.02 mm (at least 0.01 mm in one-side difference). When the diameter difference is at least 0.02 mm, the slide sleeve 40 is given high slidability and excellent sealing properties while holding the tip main body 20 out of contact with the inner surface of the plunger sleeve 60.

Incidentally, the slide sleeve 40 may comprise a single hollow cylinder as shown in FIG. 1, or a plurality of slide sleeves 40 may be arranged axially of the tip main body 20 as shown in FIGS. 2 and 3. When a plurality of slide sleeves are arranged in the axial direction, divided slide sleeves 40 can be arranged respectively in a plurality of grooves 26 formed in the tip main body 20 as seen in FIG. 2. Alternatively, annular spacers 24 may be arranged between respective adjacent pairs of slide sleeves 40 as fitted in a groove 26 as shown in FIG. 3.

In any case, it is desired that the slide sleeve 40 occupy a region of at least 50 to 90% of the area of the outer peripheral surface of the tip main body 20.

It is desired that the slide sleeve 40 have an outside diameter which is about 0.02 to 0.08 mm smaller than the inside diameter of the plunger sleeve 60 so as to be smoothly inserted into the plunger sleeve 60. The smaller this diameter difference is, the more stabilized the slidability available is for injection. It is then possible to prevent the ingress of the molten metal into the interstice, enabling the slide sleeve to exhibit excellent sealing properties.

The rigid resin material for making the slide sleeve 40 is selected from among materials exhibiting high slidability and excellent sealing properties on the plunger sleeve 60.

Preferably, the rigid resin material to be selected is at least $6.895\times10^{7}$ Pa in modulus of elasticity and greater than the tip main body 20 in coefficient of thermal expansion (coefficient of linear expansion). If the rigid resin material is smaller than the tip main body 20 in coefficient of thermal expansion, the tip main body 20 is likely to come into contact with the inner surface of the plunger sleeve 60 when the slide sleeve 40 and the tip main body 20 are thermally expanded. Stated more specifically, it is desirable that the rigid resin material be at least $1.2\times10^{-5}$/° C. in coefficient of thermal expansion.

The upper limit of the coefficient of thermal expansion of the rigid resin material is preferably up to $6\times10^{-5}$/° C., more preferably up to $5\times10^{-5}$/° C. because if the coefficient of thermal expansion is greater than $6\times10^{-5}$/° C., the slide sleeve 40 will thermally expand to excess when exposed to heat to encounter increased sliding resistance on the plunger sleeve 60.

Although the tip main body 20 can be prevented from rising in temperature when internally provided with the water cooling structure described above, the rise in the temperature of the slide sleeve 40 is inevitable due to the transfer of heat from the tip main body 20 which becomes heated by contact with molten metal having a temperature of 600 to 700° C. For this reason, to prevent the rigid resin material from becoming impaired in slidability and sealing properties due to degradation, it is desired that the material to be selected be higher than 200° C. in deflection temperature under load (heat distortion temperature). Incidentally, the deflection temperature under load is measured according to JIS K7207 and K6911.

Most preferably, the material for the slide sleeve to be selected has the characteristics described above. Examples of such rigid resin materials are polyamide (PA), polybenzimidazole (PBI), polyether ether ketone (PEEK) and polyimide (PI). For example, polybenzimidazole is commercially available under the trade name of Celazole (trademark, product of Clariant Japan K.K.) and polyimide is commercially available under the trade name of Vespel (trademark, product of DuPoint).

Further improved lubricity is available by adding carbon fiber, boron nitride powder or like material to these rigid resins.

EXAMPLES

Specimen plunger tips (Invention Examples 1 to 7 and Comparative Example), each having a slide sleeve made of a material shown in Table 1, were prepared for use in respective plunger sleeves of SKD-61. Each plunger tip was slidingly moved to force molten aluminum alloy (ADC12) into a die to obtain a die-cast product. The products thus prepared were compared as to the quality, and the plunger tips were also compared as to the number of times the tip was used.

TABLE 1

| | Material of slide sleeve | Area of outer peripheral surface occupied (%) | Deflection temp. under load (° C.) | Coefficient of thermal expansion | Number of useful shots |
|---|---|---|---|---|---|
| Invention Ex. 1 | PA46 | 80 | 285 | $3 \times 10^{-5}$ | 1025 |
| Invention Ex. 2 | PBI | 80 | 435 | $2.3 \times 10^{-5}$ | 1520 |
| Invention Ex. 3 | PEEK | 80 | 315 | $1.5 \times 10^{-5}$ | 1200 |
| Invention Ex. 4 | PI | 55 | 330 | $5.4 \times 10^{-5}$ | 1000 |
| Invention Ex. 5 | PAR | 80 | 180 | $2.1 \times 10^{-5}$ | 300 |
| Invention Ex. 6 | PEI | 80 | 210 | $5.6 \times 10^{-5}$ | 900 |
| Invention Ex. 7 | PEEK | 45 | 315 | $1.5 \times 10^{-5}$ | 450 |
| Comp. Ex. | C/C composite | 80 | — | — | 150 |

As to the abbreviations used for Invention Examples in Table 1, PA46 stands for polyamide 46, PBI for polybenzimidazole, PEEK for polyether ether ketone, PI for polyimide, PAR for polyarylate and PEI for polyether imide. These are all rigid resin materials.

C/C composite was used for making the slide sleeve of the plunger tip of Comparative Example.

The plunger tips were used for injecting molten aluminum alloy (ADC12) into the die under pressure of 50 MPa and checked for the number of times the tip was used (number of useful shots) and also for slidability. The result is given in Table 1, right-end column.

Table 1 shows that Invention Examples 1 to 7 are greater than Comparative Example in the number of shots and are therefore longer in service life. This is because the slide sleeve of the invention radially enlarges due to the thermal expansion of the rigid resin material, slidingly moves in intimate contact with the inner surface of the plunger sleeve and exhibits higher sealing properties than the slide sleeve of C/C composite having a lower coefficient of thermal expansion. The result given in Table 1 will be discussed in greater detail.

The slide sleeve of Invention Example 1 developed minute cracks, but exhibited stabilized slidability and achieved a shot number of 1050 to show high durability.

The slide sleeve of Invention Example 2 was free from cracks, exhibited stabilized slidability and achieved a shot number of 1520, thus substantiating the highest durability.

Although developing minute cracks, the slide sleeve of Invention Example 3 was stabilized in slidability and achieved a shot number of 1200, thus showing high durability.

According to Invention Example 4, the area of the outer peripheral surface of the tip main body occupied by the slide sleeve was diminished to 55%, but was found to have durability corresponding to at least 1000 successive shots.

In the case of Invention Example 5, the slide sleeve was low in deflection temperature under load and therefore developed great cracks due to a rise in temperature entailing deterioration. This reveals that the rigid resin material is preferably at least 200° C. in deflection temperature under load.

The slide sleeve of Invention Example 6 had a great coefficient of thermal expansion, accordingly thermally expanded with a rise in temperature and encountered increased resistance when sliding on the plunger sleeve. This reveals that the coefficient of thermal expansion of the rigid resin material is preferably up to $6.0\times10^{-5}$/° C., more preferably up to $5.0\times10^{-5}$/° C. to ensure higher durability.

Although the slide sleeve of Invention Example 7 initially exhibited stabilized slidability, the sleeve became lower in slidability with an increase in the number of shots, and seizure occurred between the slide sleeve and the plunger sleeve. The reason appears attributable to an increased sliding load between the plunger sleeve and the slide sleeve due to a small area of the outer peripheral surface of the tip main body occupied by the slide sleeve. This reveals that the area of the outer peripheral surface of the tip main body to be occupied by the slide sleeve is preferably at least 50%.

In the case of Comparative Example, on the other hand, the slide sleeve was made from C/C composite, therefore permitted ingress of molten aluminum alloy into an interstice between the slide sleeve and the plunger sleeve when the plunger tip was used for 150 shots, and the tip became no longer usable owing to increased resistance to sliding. This appears attributable to the low coefficient of thermal expansion of the C/C composite which fails to ensure a satisfactory sealing properties.

Since the plunger sleeve of the present invention uses no lubricant, the die-cast product prepared is free from the lubricant and has an excellent quality. The use of no lubricant eliminates the gas to be produced from the lubricant on burning, obviating the likelihood of impairing the work environment.

Although the lubricant may be sprayed onto the inner surface of the plunger sleeve 60 to further improve the slidability and sealing properties, the desired result can be obtained using the lubricant in the most reduced amount heretofore possible.

Apparently, the present invention can be altered or modified by one skilled in the art without departing from the spirit of the invention. Such modification is included within the scope of the invention as set forth in the appended claims.

INDUSTRIAL APPLICABILITY

The invention provides a plunger tip which comprises a slide sleeve of rigid resin, and which is therefore excellent in slidability and sealing properties, prolonged in service life, capable of making die-cast products with good stability and useful for die casting.

What is claimed is:

1. A plunger tip in die casting machines comprising a tip main body and slidable inside a plunger sleeve for pushing out a molten metal into a die, the plunger tip being characterized in that the tip main body is made of a metal material and covered over an outer peripheral surface thereof with a slide sleeve made of a rigid resin material.

2. The plunger tip in die casting machines according to claim 1 wherein the tip main body is covered with the slide sleeve over a region of at least 50% of the area of the outer peripheral surface thereof.

3. The plunger tip in die casting machines according to claim 1 wherein the tip main body has a front end and an outer peripheral surface not covered with the slide sleeve, the front end and the uncovered outer peripheral surface being made of the same metal material.

4. The plunger tip in die casting machines according to claim 1 wherein the slide sleeve has an outside diameter equal to or approximately equal to the outside diameter of the tip main body.

5. The plunger tip in die casting machines according to claim 1 wherein the slide sleeve has an outside diameter at least 0.02 mm larger than the outside diameter of the tip main body.

6. The plunger tip in die casting machines according to claim 1 wherein the slide sleeve is made of a rigid resin material having a deflection temperature under load higher than 200° C.

7. The plunger tip in die casting machines according to claim 1 wherein the slide sleeve is made of a rigid resin material having a coefficient of thermal expansion (coefficient of linear expansion) of $1.2\times10^{-5}$/° C. to $6\times10^{-5}$/° C.

* * * * *